United States Patent [19]

Petersen et al.

[11] Patent Number: 4,794,102

[45] Date of Patent: Dec. 27, 1988

[54] THERMALLY-RESPONSIVE RECORD MATERIAL

[75] Inventors: Thomas C. Petersen; Dean G. Dalebroux, both of Appleton, Wis.

[73] Assignee: Appleton Papers Inc., Appleton, Wis.

[21] Appl. No.: 92,490

[22] Filed: Sep. 3, 1987

[51] Int. Cl.[4] ..... B41M 5/18

[52] U.S. Cl. ..... 503/209; 427/150; 427/151; 428/500; 428/913; 503/208; 503/214; 503/216; 503/221

[58] Field of Search ..... 427/150–152; 503/208, 209, 214, 216, 217, 221, 225; 428/195, 500, 913, 914

[56] References Cited

U.S. PATENT DOCUMENTS

| | | | |
|---|---|---|---|
| 3,944,695 | 3/1976 | Kosaka et al. | 427/148 |
| 4,032,690 | 6/1977 | Kohmura et al. | 427/151 |
| 4,134,847 | 1/1979 | Oda et al. | 427/150 |
| 4,236,732 | 12/1980 | Murakami et al. | 428/913 |
| 4,336,067 | 6/1982 | Shackle et al. | 106/21 |
| 4,339,275 | 7/1982 | Tutty | 427/150 |
| 4,470,057 | 9/1984 | Glanz | 503/209 |
| 4,507,669 | 3/1985 | Sakamoto et al. | 503/207 |
| 4,535,347 | 8/1985 | Glanz | 503/208 |
| 4,544,936 | 10/1985 | Yokoi | 503/209 |
| 4,546,365 | 10/1985 | Brockett et al. | 503/214 |
| 4,558,335 | 12/1985 | Hanayama et al. | 503/209 |
| 4,616,240 | 10/1986 | Inaba et al. | 503/208 |

FOREIGN PATENT DOCUMENTS

| | | | |
|---|---|---|---|
| 57-137186 | 8/1982 | Japan | 503/208 |
| 61-160291 | 7/1986 | Japan | 503/208 |
| 61-160290 | 7/1986 | Japan | 503/208 |

*Primary Examiner*—Bruce H. Hess
*Attorney, Agent, or Firm*—Benjamin Mieliulis

[57] ABSTRACT

A high sensitivity thermal paper resistant to image erasure is disclosed. The thermal paper has a color-forming composition comprising a chromogenic material, an acidic developer material, a water insoluble polymer consisting of poly α-methylstyrene or α-methylstyrene/vinyltoluene copolymer, and a thermal modifier. Preferably the thermal modifier is selected from acetoacet-o-toluidine, diphenoxyethane, phenyl-1-hydroxy-2-naphthoate, diheptadecyl ketone and octadecanamide. The disclosed composition when thermally imaged is surprisingly resistant to image erasure and smearing attributable to fingerprint oils.

13 Claims, No Drawings

THERMALLY-RESPONSIVE RECORD MATERIAL

BACKGROUND OF THE INVENTION

1. Field of the Invention

This invention relates to thermally-responsive record material. In particular this invention relates to such record material in the form of sheets coated with color-forming systems comprising chromogenic material and acidic color developer material. More particularly, this invention relates to record material having improved resistance to fingerprinting and smearing upon being handled.

2. Description of the Invention

Thermally-responsive record material system are well known in the art and are described in many patents, for example U.S. Pat. Nos. 3,539,375; 3,674,535; 3,746,675; 4,151,748; 4,181,771; 4,246,318 and 4,470,057 incorporated herein by reference. In these systems, basic chromogenic material and acidic developer material are contained in a coating on a substrate which, when heated to a suitable temperature, melts or softens to permit said materials to react, thereby producing a colored mark.

Thermally-responsive record materials have been progressively improved in sensitivity over the years in keeping with the requirements imposed by faster and faster facsimile equipment transmission and operating rates. High sensitivity thermal paper must promptly and efficiently form a high density mark upon thermal heating. As sensitivities have increased with the use of thermal modifiers, a vexing problem has emerged with high sensitivity thermal papers of image erasure and smearing from fingerprint oils upon being handled following image formation. A need has arisen with high sensitivity thermal papers for coated composition which resist image erasure due to fingerprint oils.

U.S. Pat. No. 4,134,847 to Oda et al. disclosed a developer composition comprising an aromatic carboxylic acid and oxide or carbonate of a polyvalent metal and including a polymeric material such as poly α-methylstyrene.

U.S. Pat. No. 4,470,057 to Glanz disclosed thermally-responsive record materials which can include a latex binder such as polystyrene latex to protect the coated materials from brushing and handling forces.

None of the prior art recognized the superior resistance to image erasure due to fingerprint oils achieveable with a coating containing poly-α-methylstyrene or α-methylstyrene-vinyltoluene copolymer in combination with a thermal modifier such as acetoacet-o-toluidine, diphenoxyethane, phenyl-1-hydroxy-2-naphthoate, diheptadecyl ketone, or octadecanamide.

It is an object of the present invention to provide a thermally-responsive record material which resists smearing and/or image erasure upon contact with fingerprint oils and commonly used lotions.

SUMMARY OF THE INVENTION

The present invention is a thermally-responsive record material which has coatings which resist image erasure and smearing upon contact with fingerprint oils. The present invention is a thermally-responsive record material comprising a support member bearing a thermally-sensitive color-forming composition comprising chromogenic material, an acidic developer material wherein the improvement comprises including in addition water insoluble poly-α-methylstyrene or α-methylstyrene/vinyltoluene copolymer, in combination with acetoacet-o-toluidine, diphenoxyethane, phenyl-1-hydroxy-2-naphthoate, diheptadecyl ketone or octadecanamide.

The thermally-responsive record material of the invention comprises a support member bearing a thermally-sensitive color-forming composition. The thermally-sensitive color-forming composition comprises chromogenic material, and in contiguous relationship, an acidic developer material whereby the melting or sublimation of either material produces a change in color by reaction between the two. Additionally a water insoluble polymeric compound selected from the group consisting of poly α-methylstyrene and copolymer of α-methylstyrene/vinyltoluene, is ground and then mixed into the composition and in combination therewith, there is included a thermal modifier selected from the group consisting of acetoacet-o-toluidine, diphenoxyethane, phenyl-1-hydroxy-2-naphthoate, diheptadecyl ketone or octodecanamide and a binder along with common fillers, lubricants, and can include the common ingredients for handling or rheology. A clearly defined structural correlation with the effectiveness of the thermal modifier was not readily apparent.

The color-forming composition or system of the record material of this invention comprises chromogenic material in its substantially colorless state and acidic developer material such as, for example, phenolic compounds. The color-forming system relies upon melting or subliming one or more of the components to achieve reactive, color-producing contact.

The record material includes a substrate or support material which is generally in sheet form. For purposes of this invention, sheets also mean webs, ribbons, tapes, belts, films, cards and the like. Sheets denote articles having two large surface dimensions and a comparatively small thickness dimension. The substrate or support material can be opaque, transparent or translucent and could, itself, be colored or not. The material can be fibrous including, for example, paper and filamentous synthetic materials. It can be a film including, for example, cellophane and synthetic polymeric sheets cast, extruded, or otherwise formed. The invention substantially resides in the color-forming composition coated on the substrate. The kind or type of substrate material is largely a matter of choice.

The components of the color-forming system are in a contiguous relationship, substantially homogeneously distributed throughout the coated layer material deposited on the substrate. In manufacturing the record material, a coating composition is prepared which includes a fine dispersion of the components of the color-forming system, polymeric binder material, surface active agents and other additives in an aqueous coating medium. The composition can additionally contain inert pigments, such as silica, clay, talc, aluminum hydroxide, calcined kaolin clay and calcium carbonate; synthetic pigments, such as urea-formaldehyde resin pigments; natural waxes such as Carnuba wax; synthetic waxes; lubricants such as zinc stearate; wetting agents and defoamers.

The color-forming system components are substantially insoluble in the dispersion vehicle (preferably water) and are ground to an individual average particle size of between about 0.1 micron to about 10 microns, preferable about 3 microns. The polymeric binder material is substantially vehicle soluble although latexes are also eligible in some instances. Preferred water soluble binders include polyvinyl alcohol, hydroxy ethylcellulose, methylcellulose, methyl-hydroxypropylcellulose, starch, modified starches, gelatin and the llike. Eligible latex materials include polyacrylates, polyvinylacetates, polystyrene-butadiene, and the like. The polymeric binder is used to protect the coated materials from brushing and handling forces occasioned by storage and use of the thermal sheets. Binder should be present in an amount to afford such protection and in an amount less than will interfere with achieving reactive contact between color-forming reactive materials.

Coating weights can effectively be about 3 to about 14 grams per square meter (gsm) and preferably about 5 to about 6 gsm. The practical amount of color-forming materials is controlled by economic considerations, functional parameters and desired handling characteristics of the coated sheets.

Eligible chromogenic compounds, such as the phthalide, leucauramine and fluoran compounds for use in the color-forming system are well known color-forming compounds. Examples of the compounds include Crystal Violet Lactone (3,3-bis(4-dimethylaminophenyl)-6-dimethylaminophthaline, U.S. Pat. No. Re. 23,024); phenyl-, indol-, pyrrol-, and carbazol-substituted phthalides for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilino-fluoran (U.S. Pat. No. 3,681,390); 7-(1-ethyl-2-methylindol-3-yl)-7-(4-diethylamino-2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino-2-ethoxyphenyl)-5,7-dihydrofuro[3,4-b]-pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; and 3'-phenyl-7-dibenzylamino-2,2'-spiro-di[2H-1-benzopyran].

Examples of eligible acidic developer material include the compounds listed in U.S. Pat. No. 3,539,375 as phenolic reactive material, particularly the monophenols and diphenols. Eligible acidic developer material also includes, without being considered as limiting, the following compounds which may be used individually or in mixtures: 4,4'-isopropylidinediphenol (Bisphenol A); p-hydroxybenzaldehyde; p-hydroxybenzophenone; p-hydroxypropiophenone; 2,4-dihydroxybenzophenone; 1,1-bis(4-hydroxy-3-methylphenyl)-cyclohexane; 1,1-bis(4-hydroxyphenyl)cyclohexane; salicylanilide; 4-hydroxy-2-methylacetophenone; 2-acetylbenzoic acid; m-hydroxyacetanilide; p-hydroxyacetanilide; 2,4-dihydroxyacetophenone; 4-hydroxy-4'-methylbenzophenone; 4,4'-dihydroxybenzophenone; 2,2-bis(4-hydroxyphenyl)-4-methylpentane; benzyl 4-hydroxyphenyl ketone; 2,2-bis(4-hydroxyphenyl)-5-methylhexane; ethyl-4,4-bis(4-hydroxyphenyl)-pentanoate; n-propyl-4,4-bis(4-hydroxyphenyl)pentanoate; isopropyl-4,4-bis(4-hydroxyphenyl)pentanoate; methyl-4,4-bis(4-hydroxyphenyl)pentanoate; 3,3-bis(4-hydroxyphenyl)-pentane; 4,4-bis(4-hydroxyphenyl)-heptane; 2,2-bis(4-hydroxyphenyl)-1-phenylpropane; 2,2-bis(4-hydroxyphenyl)butane; 2,2'-methylene-bis(4-ethyl-6-tertiarylbutyl phenol); 4-hydroxycoumarin; 7-hydroxy-4-methylcoumarin; 2,2'-methylene-bis(4-octyl phenol); 4,4'-sulfonyldiphenol; 4,4'-thiobis(6-tertiarybutyl-m-cresol); methyl-p-hydroxybenzoate; n-propyl-p-hydroxybenzoate; benzyl-p-hydroxybenzoate. Preferred among these are the phenolic developer compounds. More preferred among the phenol compounds are 4,4'-isopropylindinediphenol and 2,2-bis(4-hydroxyphenyl)-4-methylpentane. Acid compounds of other kinds and types are eligible. Examples of such other compounds are phenolic novolak resins which are the product of reaction between, for example, formaldehyde and a phenol such as an alkylphenol, e.g., p-octylphenol, or other phenols such as p-phenylphenol, and the like; and acid mineral materials including colloidal silica, kaolin, bentonite, attapulgite, hallosyte, and the like, Some of the polymers and minerals do not melt but undergo color reaction on fusion of the chromogen.

Included in the coated layer material deposited on the substrate is finely dispersed polyα-methylstyrene, or a copolymer of α-methylstyrene and vinyltoluene, along with a thermal modifier, selected from acetoacet-o-toluidine, diphenoxyethane, phenyl-1-hydroxy-2-naphthoate, diheptadecyl ketone or octadecamide.

In making the coated layer, separate dispersions are made of the chromogenic compound, polymeric compound, and thermal modifier. Separate dispersions are prepared of such that in the final coating the chromogenic compound is at 3–12% by weight, the polyα-methylmethylstyrene) or copolymer of α-methylstyrene and vinyltoluene is at 2–20% by weight, and the thermal modifier is at 10–30% by weight. A separate dispersion is also made of the acidic developer material such that it is at 10–30% by weight in the final coating. These material are dispersed in preferably an aqueous vehicle.

Fillers, antioxidants, lubricants, waxes, binders, and brighteners may be added if so desired to improve handling characteristics. The coating mixture is applied to the substrate with a conventional coater such as a wire wound rod, dried, and calendered if desired.

The composition of the invention, optionally and alternatively, can be assembled as a two coat system. The polyα-methylstyrene or copolymers of α-methylstyrene and vinyltoluene can be dispersed and mixed with any of the conventional fillers, waxes, binders, or brighteners. This mixture can be applied to the substrate with a wire wound rod and dried. Over this coating can be applied a second mixture formed of a dispersion of the chromogenic material, acidic developing material, and other materials such as fillers, waxes, binders, and brighteners. This top coat is dried and calendered. In this manner, a two-layer recording system is formed with the poly-α-methylstyrene (or copolymer with vinyl toluene) contained in the subcoat and the chromogenic material and the acidic developing material and thermal modifier contained in the top coat.

EXAMPLES

EXAMPLES 1–12

Examples 1, 6, and 11 are identical controls.

Examples 2–5 show the improved image stability when poly-α-methylstyrene is incorporated into the coating. Example 1 being the control coating prepared without the polymer. All examples #'s 2–5 include the thermal modifier acetoacet-o-toluidine.

Examples 7–10 show the improved image stability when the α-methylstyrene/vinyltoluene copolymer is incorporated together with acetoacet-o-toluidine into the coating.

Example 12 shows the improved image stability when poly-α-methylstyrene is included in a subcoat over which is placed the thermal sensitive layer. Example 11 serves as the control (not subcoated) coating.

(For clarity, Tables 3 & 4 outline Examples 1–24 on a dry weight basis.).

The above dispersions may be prepared with water soluble binders other than polyvinyl alcohol. Nopco NDW (a sulfonated caster oil produced by Nopco Chemical Co.) and Surfynol 104 (a di-tertiary acetylene glycol surface active agent produced by Air Products and Chemicals, Inc.) were used as the defoamer and dispersing agent in the above dispersions. Resito Coat 135 (a paraffin wax emulsion) was added as a lubricant in the pigment dispersion (E).

The thermal response of the sheet was tested by producing an image with a Group III facsimile printer (HIFAX 3M EMT 2700) using a solid block test pattern. The resulting image was measured using a Macbeth RD 514 reflection desitometer through a Wratten 106 filter. The instrument was calibrated such that a value of 0.04 indicated pure white and 1.78 a fully saturated black (see Table 1).

Fingerprint resistance was determined by applying a hand lotion (SBS 40 Medicated Skin Cream manufactured by Sugar Beet Products Co.) to a freshly imaged area of the thermal sensitive paper with a finger. The lotion remained in contact with the image throughout the experiment. The image intensity was monitored as a function of time and when forty percent of the original image intensity was lost the sample was considered to have failed.

Dispersion A Chromogenic Material

| | Parts |
|---|---|
| Chromogenic Material | 32.0 |
| Binder, 20% Solution of Polyvinyl Alcohol in Water | 27.4 |
| Defoaming and Dispersion Agents | 0.4 |
| Water | 40.2 |

Dispersion A-a Chromogenic Material is 3-diethylamino-6-methyl-7-anilinofluoran.

Dispersion B Acidic Material

| | Parts |
|---|---|
| Acidic Material | 42.5 |
| Binder, 20% Solution of Polyvinyl Alcohol in Water | 21.2 |
| Defoaming and Dispersing Agents | 0.2 |
| Water | 36.1 |

Dispersion B-a Acidic Material is 2,2-bis(4-hydroxyphenyl)-4-methylpentane.

Dispersion C Thermal Response Modifier

| | Parts |
|---|---|
| Thermal Modifier | 42.5 |
| Binder, 20% Solution of Polyvinyl Alcohol in Water | 21.2 |

-continued

| | Parts |
|---|---|
| Defoaming and Dispersing Agents | 0.2 |
| Water | 36.1 |

Dispersion C-a Thermal Response Modifier is acetoacet-o-toluidine.

Dispersion D Lubricant Dispersion

| | Parts |
|---|---|
| Zinc Stearate | 10.2 |
| Behenyl Alcohol | 7.9 |
| Binder, 20% Solution of Polyvinyl Alcohol in Water | 8.7 |
| Defoaming and Dispersing Agents | 0.2 |
| Water | 73.0 |

Dispersion E Pigment Dispersion

| | Parts |
|---|---|
| Fumed Silica | 8.7 |
| Urea-Formaldehyde Resin | 4.1 |
| Binder, 10% Solution of Polyvinyl Alcohol in Water | 23.8 |
| Defoaming and Dispersing Agents | 0.8 |
| Water | 62.6 |

Dispersion F Hydrocarbon Resin Dispersion

| | Parts |
|---|---|
| Hydrocarbon Resin | 17.0 |
| Binder, 10% Solution of Polyvinyl Alcohol in Water | 30.0 |
| Defoaming and Dispersing Agents | 0.2 |
| Water | 52.8 |

Dispersion F-a Hydrocarbon Resin is α-methylstyrene commercially available as Kristalex 1120®

Dispersion F-b Hydrocarbon Resin is α-methylstyrene/vinyltoluene commercially available as Piccotex 100®

Combined Dispersion

| | Parts |
|---|---|
| Dispersion A | 10.3 |
| Dispersion B | 20.6 |
| Dispersion C | 25.9 |
| Dispersion D | 21.7 |
| Binder, 10% PVA in Water | 21.5 |

Coating Formulation I Control

| | Parts |
|---|---|
| Combined Dispersion | 45.6 |
| Dispersion E | 33.1 |
| Water | 21.3 |

Coating Formulation II Hydrocarbon Resin (Level 1)

| | Parts |
|---|---|
| Combined Dispersion | 45.6 |
| Dispersion E | 30.1 |
| Dispersion F | 2.4 |

-continued

| | Parts |
|---|---|
| Water | 21.9 |

Coating Formulation III Hydrocarbon Resin (Level 2)

| | Parts |
|---|---|
| Combined Dispersion | 45.6 |
| Dispersion E | 25.5 |
| Dispersion F | 5.9 |
| Water | 23.0 |

Coating Formulation IV Hydrocarbon Resin (Level 3)

| | Parts |
|---|---|
| Combined Dispersion | 45.6 |
| Dispersion E | 20.9 |
| Dispersion F | 9.4 |
| Water | 24.1 |

Coating Formulation V Hydrocarbon Resin (Level 4)

| | Parts |
|---|---|
| Combined Dispersion | 45.6 |
| Dispersion E | 17.8 |
| Dispersion F | 11.8 |
| Water | 24.8 |

EXAMPLE 1

Formulation I (Control)

(This coating includes no α-methylstyrene or α-methylstyrene/vinyltoluene. Acetoacet-o-toluidine is included in all Examples 1–12).

EXAMPLE 2

Formulation II

Dispersion F-a (This coating includes α-methylstyrene. Examples 3–5 include increasing amounts of α-methylstyrene. Modifier is acetoacet-o-toluidine.

EXAMPLE 3

Formulation III

Dispersion F-a (This coating includes α-methylstyrene. Modifier is acetoacet-o-toluidine.)

EXAMPLE 4

Formulation IV

Dispersion F-a (This coating includes α-methylstyrene. Modifier is acetoacet-o-toluidine.)

EXAMPLE 5

Formulation V

Dispersion F-a (This coating includes α-methylstyrene. Modifier is acetoacet-o-toluidine.)

EXAMPLE 6

Formulation I (Control)

(This coating includes no α-methylstyrene or α-methylstyrene/vinyltoluene.) Acetoacet-o-toluidine modifier is included.

EXAMPLE 7

Formulation II

Dispersion F-b (This coating includes α-methylstyrene/vinyltoluene. Modifier is acetoacet-o-toluidine. Examples 8–10 include increasing amounts of α-methylstyrene/vinyltoluene.)

EXAMPLE 8

Formulation III

Dispersion F-b (This coating includes α-methylstyrene/vinyltoluene. Modifier is acetoacet-o-toluidine.)

EXAMPLE 9

Formulation IV

Dispersion F-b (This coating includes α-methylstyrene/vinyltoluene. Modifier is acetoacet-o-toluidine.)

EXAMPLE 10

Formulation V

Dispersion F-b (This coating includes α-methylstyrene/vinyltoluene. Modifier is acetoacet-o-toluidine.)

EXAMPLE 11

Formulation I (Control)

EXAMPLE 12

Two Layer Coating

Dispersion F-a as Subcoat (F-a includes α-methylstyrene) Formulation I as Topcoat

TABLE 1

Fingerprint Resistance Data

| Example | Original Macbeth Image Density | Image Erasure Over Time* Length of Exposure (Days) | | | | | | | |
|---|---|---|---|---|---|---|---|---|---|
| | | 0 | 1 | 6 | 11 | 15 | 21 | 26 | 31 |
| 1 | 1.37 | + | + | + | − | − | − | − | − |
| 2 | 1.36 | + | + | + | + | + | + | + | + |
| 3 | 1.34 | + | + | + | + | + | + | + | + |
| 4 | 1.30 | + | + | + | + | + | + | + | + |
| 5 | 1.30 | + | + | + | + | + | + | + | + |
| | | 0 | 1 | 4 | 6 | 8 | 18 | | |
| 6 | 1.31 | + | + | + | − | − | − | | |
| 7 | 1.31 | + | + | + | + | + | + | | |
| 8 | 1.30 | + | + | + | + | + | + | | |
| 9 | 1.25 | + | + | + | + | + | + | | |
| 10 | 1.21 | + | + | + | + | + | + | | |
| | | 0 | 1 | 3 | 7 | 21 | 24 | | |
| 11 | 1.31 | + | + | + | − | − | − | | |
| 12 | 1.31 | + | + | + | + | + | + | | |

*A "−" indicates the loss of at least 40% of the original image density.

EXAMPLES 13–24

Examples 13, 15, 17, 19, 21 and 23 are controls (coating formulation I) where none of the hydrocarbon resin claimed in the invention is present and baseline fade data for each of the various modifiers is established. In examples 14, 16, 18, 20 and 22 (coating formulation IV) dispersion F-b (α-methyl styrene vinyl toluene copolymer resin) is used with the various modifiers to retard "fingerprinting".

(For clarity, Tables 3 & 4 outline Examples 1–24 on a dry weight basis.).

EXAMPLES 13 & 14

A control using the previously disclosed modifier acetoacet-o-toluidine.

EXAMPLES 15 & 16

Thermal response modifier is diphenoxyethane (DPE).

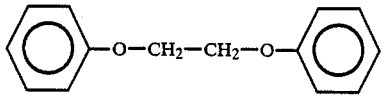

EXAMPLES 17 & 18

Thermal response modifier is phenyl-1-hydroxy-2-naphthoate (PHNT).

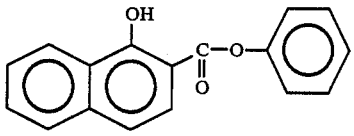

EXAMPLES 19 & 20

Thermal response modifier is Stearone TM Wax, the principle constituent of which is of the formula: (Stearone Wax is a trademark product of Argus Chemical Division of Witco.).

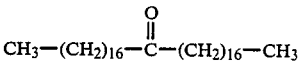

diheptadecyl ketone

EXAMPLES 21 & 22

Thermal response modifier is Kemamide TM B Wax, the principle constituent of which is of the formula: (Kemamide B is a trademark product of Humko Sheffield.).

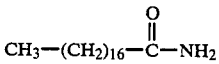

octadecanamide

EXAMPLES 23 & 24

Thermal response modifier is the previously disclosed acetoacet-o-toluidine. Example 24 (coating formulation IV) uses a water dispersable polystyrene latex (reported in the prior art in thermal formulations) in place of the α-methylstyrene/vinyltoluene copolymer to show that it has little if any effect on "fingerprinting". The latex used was purchased from Dow Chemical Company as Dow Plastic Pigment 722.

TABLE 2

| | Fingerprint Resistance Data | | | | | | | | | | |
|---|---|---|---|---|---|---|---|---|---|---|---|
| | Original MacBeth Image | Image Erasure Over Time Length of Exposure (Days) | | | | | | | | | |
| Example | Density | 0 | 1 | 4 | 6 | 8 | 11 | 15 | 22 | 32 | 54 |
| 13 (AAOT Control) | 1.32 | + | + | + | + | + | + | + | + | − | − |
| 14 | 1.38 | + | + | + | + | + | + | + | + | + | + |
| 15 (DPE Control) | 1.34 | + | + | + | + | + | + | + | + | + | +* |
| 16 | 1.38 | + | + | + | + | + | + | + | + | + | + |
| 17 (PHNT Control) | 1.30 | + | + | + | + | + | + | − | − | − | − |
| 18 | 1.34 | + | + | + | + | + | + | + | + | + | + |
| 19 (Stearone Control) | 1.21 | + | + | + | + | + | − | − | − | − | − |
| 20 | 1.21 | + | + | + | + | + | + | + | + | + | + |
| 21 (Kemamide B Control) | 1.38 | + | + | + | + | + | + | + | − | − | − |
| 22 | 1.38 | + | + | + | + | + | + | + | + | + | + |
| 23 (AAOT Control) | 1.32 | + | + | + | + | + | + | + | + | − | − |
| 24 (8% Polystyrene Latex) | 1.34 | + | + | + | + | + | + | + | + | + | − |

A "−" indicates at least a 40% decline in the original MacBeth Image Intensity.

*After 54 days the DPE control example #15 lost a total of 32% of its original image density; however, example #16 which contains 8% - methylstyrene/vinyltoluene copolymer lost only 9% of its image density.

TABLE 3

| | % of Dry Coating Weight Examples From Table 1 | | | | | | | | | | | |
|---|---|---|---|---|---|---|---|---|---|---|---|---|
| Coating Component | 1 | 6 | 11 | 12 | 2 | 3 | 4 | 5 | 7 | 8 | 9 | 10 |
| 3-diethylamino-6-methyl-7-anilinofluoran | 7.5 | 7.5 | 7.5 | 7.5 | 7.5 | 7.5 | 7.5 | 7.5 | 7.5 | 7.5 | 7.5 | 7.5 |
| 2,2-bis(4-hydroxyphenyl)-4-methylpentane | 20.0 | 20.0 | 20.0 | 20.0 | 20.0 | 20.0 | 20.0 | 20.0 | 20.0 | 20.0 | 20.0 | 20.0 |
| acetoacet-o-toluidine | 25.0 | 25.0 | 25.0 | 25.0 | 25.0 | 25.0 | 25.0 | 25.0 | 25.0 | 25.0 | 25.0 | 25.0 |
| zinc stearate | 5.0 | 5.0 | 5.0 | 5.0 | 5.0 | 5.0 | 5.0 | 5.0 | 5.0 | 5.0 | 5.0 | 5.0 |
| behenyl alcohol | 3.9 | 3.9 | 3.9 | 3.9 | 3.9 | 3.9 | 3.9 | 3.9 | 3.9 | 3.9 | 3.9 | 3.9 |
| fumed silica | 14.7 | 14.7 | 14.7 | 14.7 | 13.3 | 11.3 | 9.3 | 7.9 | 13.3 | 11.3 | 9.3 | 7.9 |
| urea-formaldehyde | 7.0 | 7.0 | 7.0 | 7.0 | 6.4 | 5.4 | 4.4 | 3.8 | 6.4 | 5.4 | 4.4 | 3.8 |
| polyvinyl alcohol | 15.5 | 15.5 | 15.5 | 15.5 | 15.5 | 15.5 | 15.5 | 15.5 | 15.5 | 15.5 | 15.5 | 15.5 |
| defoaming & dispersing agents | 1.4 | 1.4 | 1.4 | 1.4 | 1.4 | 1.4 | 1.4 | 1.4 | 1.4 | 1.4 | 1.4 | 1.4 |
| poly α-methylstyrene | | | | | 2.0 | 5.0 | 8.0 | 10.0 | | | | |
| α-methylstyrene/vinyltoluene copolymer | | | | | | | | | 2.0 | 5.0 | 8.0 | 10.0 |
| TOTAL | 100.0 | 100.0 | 100.0 | 100.0 | 100.0 | 100.0 | 100.0 | 100.0 | 100.0 | 100.0 | 100.0 | 100.0 |

As the concentration of poly α-methylstyrene or α-methylstyrene/vinyltoluene increases the level of pigment (fumed silica and urea-formaldehyde resin) decreases by the same amount. All other components of the coating remain at a constant concentration.

TABLE 4

| Coating Component | % of Dry Coating Weight Examples From Table 2 | | | | | | | | | | | |
|---|---|---|---|---|---|---|---|---|---|---|---|---|
| | 13 | 14 | 15 | 16 | 17 | 18 | 19 | 20 | 21 | 22 | 23 | 24 |
| 3-diethylamino-6-methyl-7-anilinofluoran | 7.5 | 7.5 | 7.5 | 7.5 | 7.5 | 7.5 | 7.5 | 7.5 | 7.5 | 7.5 | 7.5 | 7.5 |
| 2,2-bis(4-hydroxyphenyl)-4-methylpentane | 20.0 | 20.0 | 20.0 | 20.0 | 20.0 | 20.0 | 20.0 | 20.0 | 20.0 | 20.0 | 20.0 | 20.0 |
| acetoacet-o-toluidine | 25.0 | 25.0 | | | | | | | | | 25.0 | 25.0 |
| diphenoxyethane | | | 25.0 | 25.0 | | | | | | | | |
| phenyl-l-hydroxy-2-naphthoate | | | | | 25.0 | 25.0 | | | | | | |
| diheptadecyl ketone | | | | | | | 25.0 | 25.0 | | | | |
| octadecanamide | | | | | | | | | 25.0 | 25.0 | | |
| zinc stearate | 5.0 | 5.0 | 5.0 | 5.0 | 5.0 | 5.0 | 5.0 | 5.0 | 5.0 | 5.0 | 5.0 | 5.0 |
| behenyl alcohol | 3.9 | 3.9 | 3.9 | 3.9 | 3.9 | 3.9 | 3.9 | 3.9 | 3.9 | 3.9 | 3.9 | 3.9 |
| fumed silica | 14.7 | 9.3 | 14.7 | 9.3 | 14.7 | 9.3 | 14.7 | 9.3 | 14.7 | 9.3 | 14.7 | 9.3 |
| urea-formaldehyde resin | 7.0 | 4.4 | 7.0 | 4.4 | 7.0 | 4.4 | 7.0 | 4.4 | 7.0 | 4.4 | 7.0 | 4.4 |
| polyvinyl alcohol | 15.5 | 15.5 | 15.5 | 15.5 | 15.5 | 15.5 | 15.5 | 15.5 | 15.5 | 15.5 | 15.5 | 15.5 |
| defoaming and dispersing agents | 1.4 | 1.4 | 1.4 | 1.4 | 1.4 | 1.4 | 1.4 | 1.4 | 1.4 | 1.4 | 1.4 | 1.4 |
| poly α-methylstyrene | | | | | | | | | | | | |
| α-methylstyrene/vinyltoluene copolymer | | 8.0 | | 8.0 | | 8.0 | | 8.0 | | 8.0 | | |
| polystyrene latex | | | | | | | | | | | | 8.0 |
| TOTAL | 100.0 | 100.0 | 100.0 | 100.0 | 100.0 | 100.0 | 100.0 | 100.0 | 100.0 | 100.0 | 100.0 | 100.0 |

Each series is composed of 2 examples, one without the α-methylstyrene/vinyltoluene copolymer and one example with it. As in the previous table, only the level of pigment is adjusted to compensate for the presence of the copolymer. Each series contains only one of the modifiers.

The principles, preferred embodiments, and modes of operation of the present invention have been described in the foregoing specification. The invention which is intended to be protected herein, however, is not to be construed as limited to the particular forms disclosed, since these are to be regarded as illustrative rather than restrictive. Variations and changes can be made by those skilled in the art without departing from the spirit and scope of the invention.

We claim:

1. A thermally-responsive record material resistant to image smearing comprising a support member bearing a thermally-sensitive color-forming composition, said thermally-sensitive color-forming composition comprising:

a chromogenic material, and in contiguous relationship, an acidic developer material whereby the melting or sublimation of either material produces a change in color by reaction between the two, a water insoluble polymeric compound selected from the group consisting of poly α-methylstyrene and copolymer of α-methylstyrene/vinyltoluene, and in combination therewith, a thermal modifier selected from the group consisting of acetoacet-o-toluidine, diphenoxyethane, phenyl-1-hydroxy-2-naphthoate, diheptadecyl ketone, and octadecanamide, and a binder therefor.

2. The record material of claim 1 wherein the thermal modifier comprises acetoacet-o-toluidine.

3. A record material of claim 1 wherein the thermal modifier comprises diphenoxyethane.

4. The record material of claim 1 wherein the thermal modifier comprises phenyl-1-hydroxy-2-naphthoate.

5. The record material of claim 1 wherein the thermal modifier comprises diheptadecyl ketone.

6. The record material of claim 1 wherein the thermal modifier comprises octadecanamide.

7. The record material of claim 1 wherein the thermal modifier comprises 10–30% by weight of the thermally-sensitive color forming composition.

8. The record material of claim 1 wherein the water insoluble polymeric compound comprises 2 to 20% by weight of the thermally sensitive color forming composition.

9. The record material of claim 1 wherein the thermal modifier comprises 10–30% by weight of the thermally-sensitive color forming composition.

10. The record material of claim 1 wherein the acidic developer material is a phenol compound.

11. The record material of claim 10 in which the phenol compound is selected from the group consisting of 4,4'-isopropylindinediphenol, 2,2-bis(4-hydroxyphenyl)-4-methylpentane, and 2,2-bis(4-hydroxyphenyl)-5-methylhexane.

12. The record material of claim 1 in which the chromogenic material is selected from the group consisting of 3-diethylamino-6-methyl-7-anilinofluoran; and 3-diethylamino-7-(2-chloroanilino)fluoran; 3-(N-methylcyclohexylamino)-6-methyl-7-anilinofluoran.

13. The record material of claim 1 in which the binder is selected from the group consisting of polyvinyl alcohol, methylcellulose, methyl-hydroxypropylcellulose, starch, and hydroxyethylcellulose.

* * * * *